United States Patent [19]

Sato et al.

[11] Patent Number: 4,603,063

[45] Date of Patent: Jul. 29, 1986

[54] PROCESS FOR ALLOYING FOR GALVANIZATION AND ALLOYING FURNACE THEREFOR

[75] Inventors: Kuniaki Sato; Yasuhisa Nakajima; Yamato Igarashi, all of Chiba, Japan

[73] Assignee: Kawaski Steel Corporation, Hyogo, Japan

[21] Appl. No.: 730,275

[22] Filed: May 3, 1985

[30] Foreign Application Priority Data

Jun. 30, 1984 [JP] Japan ..... 59-135536

[51] Int. Cl.[4] ..... B05D 3/02; B05C 3/12; B05C 19/02

[52] U.S. Cl. ..... 427/383.7; 118/419; 118/429

[58] Field of Search ..... 427/383.7; 118/419, 118/429

[56] References Cited

U.S. PATENT DOCUMENTS 1,890,463 12/1932 Herman ..... 427/383.7

2,824,021 2/1958 Cook et al. ..... 118/419 X

*Primary Examiner*—James R. Hoffman

*Attorney, Agent, or Firm*—Austin R. Miller

[57] ABSTRACT

A galvanizing furnace comprises a plurality of burners arrayed parallel to the surface of sheet iron to be galvanized and having burner nozzles directed upwards so that flame exiting the burner nozzles forms a screen-like wall of flame opposite and parallel to the sheet iron as the sheet iron passes through the alloying furnace. Preferably, the burners are separated into a plurality of blocks which can be controlled independently.

12 Claims, 9 Drawing Figures

PROCESS FOR ALLOYING FOR GALVANIZATION AND ALLOYING FURNACE THEREFOR

BACKGROUND OF THE INVENTION

The present invention generally relates to an alloying process in a galvanization process and an alloying surface used to carry out the alloying process. More specifically, the invention relates to an alloying step performed subsequent to a step of dipping sheet steel into a molten zinc bath.

Conventionally, it has been well known to galvanize sheet iron to form a external Fe—Zn alloy layer in galvanized sheet iron production. In conventional alloying processes, it has been difficult to exert alloying heat uniformly over the entire surface of the sheet iron. As a result, in conventional galvanization processes including this Fe—Zn alloying step, the alloyed Fe—Zn layer tends to be unevenly alloyed. If the plating layer is alloyed with the iron of the sheet to an excessive degree, the tenacity of the plating layer is degraded and the galvanizing layer may peel or spall off during subsequent manufacturing processes, such as press-forming. Conversely, if the glavanizing Zn is not adequately alloyed with the iron, the plating layer will be too hard and may crack during later machining steps.

The uneven heating prevalent in conventional alloying techniques in due largely to the fact that the alloying furnace is positioned above a molten zinc bath through which the sheet iron is dipped for application of the zinc layer. The iron passes vertically through furnace from bottom to top. A plurality of burners arranged opposite the sheet iron path exert alloying heat on the zinc layer of the sheet iron as it passes through the furnace. The burners are arranged in an array extending both laterally and vertically in order to cover a broad area including the entire wide of the sheet iron and approximately the lower half of the furnace. This conventional arrangement of the burners within the furnace, however, tends to result in a locally uneven distribution of the burner fuel, such as natural gas, and/or the air supply. Uneven distribution of the fuel and/or air results in uneven combustion among the burners. This results in uneven heat distribution across the zinc-covered sheet iron and thus uneven alloying of the zinc layer. This may even directly subject the sheet iron to the burner flame, which would generate embrittled heat spots on the alloy surface.

As will be appreciated herefrom, heat distribution control is very important in the alloying process for galvanized sheet iron. In general, in order to obtain a high-quality Fe-Zn alloy layer on the surface of the sheet metal, heat of the alloying process must be applied uniformly over the entire surface of the sheet iron and within a temperature range of 600° C. to 700° C.

Furthermore, in order to achieve stable combustion in each burner, the length of the bore and so the thickness of the associated support tile must be sufficiently great. This results in increasing of total weight of the burner array. In the prior art, these relatively heavy burners were arrayed laterally and vertically, requiring relatively strong furnace walls to support them. This implied enlarged furnace walls made of refractory bricks. Such alloying furnaces are undesirably heavy and difficult to move from one molten zinc bath to another. In addition, since the furnace walls made of refractory bricks have a great heat capacity, the response characteristics to control adjustments of the furnace temperature are rather poor. Furnace temperature control is necessary for continuous treatment of sheet iron of differing thicknesses. In other words, in order to alloy sheet iron of a different thickness than the preceding sheet, the furnace temperature must be adjusted to ensure optimal alloying. However, since the thermal inertia of the furnace is so great, a substantial length of the new sheet will be badly alloyed.

SUMMARY OF THE INVENTION

Therefore, it is an object of the present invention to provide an alloying furnace which can exert uniform alloying heat on the molten zinc layer on the sheet metal.

Another object of the invention is to provide an alloying surface which is light enough to be mobile and to have good response to furnace temperature control adjustments.

A further object of the invention is to provide an alloying process for sheet iron covered molten zinc which can subject the Fe—Zn alloying interface to uniform temperature.

In order to accomplish the above-mentioned and other objects, an alloying furnace according to the invention comprises a plurality of burners aligned laterally relative to the path of sheet through the furnace. Each burner has an upward directed nozzle discharging flame upwards parallel to the path of the sheet metal. The burner nozzles cooperated to form a thin film-like flame near the surface of the sheet iron.

Preferably, the burners are separated into a plurality of blocks, the combustion properties of which can be controlled independently of each other.

In order to accomplish these objects and other advantages, a process for forming an alloyed Fe—Zn layer comprises providing a plurality of burners aligned laterally and oriented with their burner nozzles directed upwards, the burner nozzles thus forming a screen-like flame parallel to the sheet iron path through the alloying furnace.

According to one aspect of the invention, an alloying furnace for use in a galvanization process comprises a furnace body disposed above a molten zinc bath through which sheet iron is passed, the furnace body having a sheet metal inlet opposing the zinc bath, and a sheet iron outlet in its upperface, the sheet iron following a constant path through the furnace body, and a burner means disposed within the furnace body near the sheet iron inlet and extending in a first direction essentially perpendicular to the direction of travel of the sheet iron, the burner means generating a screen-like flame extending in the first direction across the entire width of the sheet iron, lying essentially parallel to the plane of the sheet iron, and spaced at a given distance from the sheet iron in a second direction perpendicular to the plane of the sheet iron.

According to another aspect of the invention, an alloying furnace for use in a galvanization process comprises a furnace body made of a material having relatively small heat capacity and disposed above a molten zinc bath through which sheet iron passes, the furnace body having a sheet iron inlet opposing the zinc bath, and a sheet iron outlet in its upperface, the sheet iron following a fixed path through the furnace body, and a pair of burner assemblies, each extending essentially parallel to the plane of the sheet iron and in the direction perpendicular to the travel of the sheet iron inlet and disposed near the sheet iron inlet, each of the burner assemblies having burner nozzles directed upwards to generate a screen-like flame near the sheet iron path, which screen-like flame extends across the entire width of the sheet iron and lies essentially parallel to the sheet iron at a given distance therefrom.

According to a further aspect of the invention, a method of forming a Fe—Zn alloy layer on the surface of sheet iron as part of a galvanization process, comprises the steps of:

passing sheet iron through a molten zinc bath and upwards out of the zinc bath; and forming a screen-like flame opposite and essentially parallel to both sides of the sheet iron above the zinc bath by means of a pair of horizontally aligned, laterally extending, upwardly directed burner assemblies.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment, but are for explanation and understanding only.

FIGS. 8(A) and 8(B) are graphs showing of the furnace response characteristics to temperature adjustments by means of fuel supply control, wherein FIG. 8(A) shows the temperature adjustment response characteristics of a conventional furnace, and FIG. 8(B) shows the temperature response characteristics of the preferred embodiment of an alloying furnace.

DESCRIPTION OF THE PREFERRED EMBODIMENT

In order to facilitate better understanding of the preferred embodiment of an alloying furnace according to the invention, the general arrangement of alloying equipment and the structure of a typical furnace will be discussed briefly before describing the preferred embodiment of the invention.

Figure 1:
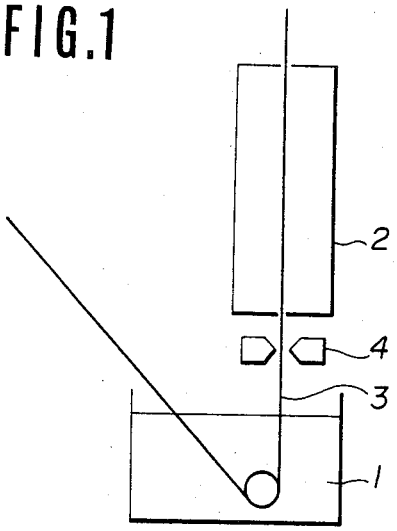
FIG. 1 is a fragmentary illustration showing relative positions of an alloying furnace and a molten zinc bath.

Referring to FIG. 1, an alloying furnace 2 is generally placed directly above a molten zinc bath 1. Sheet iron 3 is guided into the zinc bath 1 from a source such as a roll of sheet iron and then along a sheet iron path through the furnace 2. A zinc layer adjusting device 4, such as a die, a gas injection device or the like is installed in the sheet iron path between the zinc bath 1 and the alloying furnace 2. The zinc layer adjusting device 4 adjusts the thickness of the zinc layer adhering to the sheet iron surface. During upward travel along the sheet iron path through the furnace, alloying heat, preferably in the temperature range of 600° C. to 700° C., is applied to the zinc layer on the sheet iron surface to galvanize the sheet iron by forming a Fe—Zn layer on its surface.

In general, the alloying process should take place immediately after dipping the sheet iron into the molten zinc bath. Therefore, it is normal to arrange the alloying furnace 2 just above the zinc bath 1.

Figure 2:
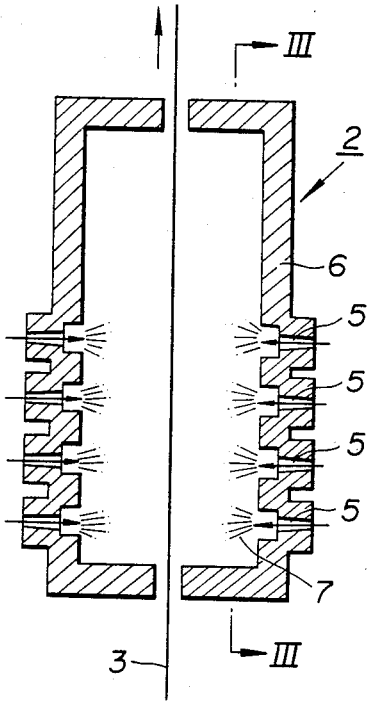
FIG.2 (PRIOR ART)
FIG. 2 is a cross-section through a conventional alloying furnace.
Figure 3:
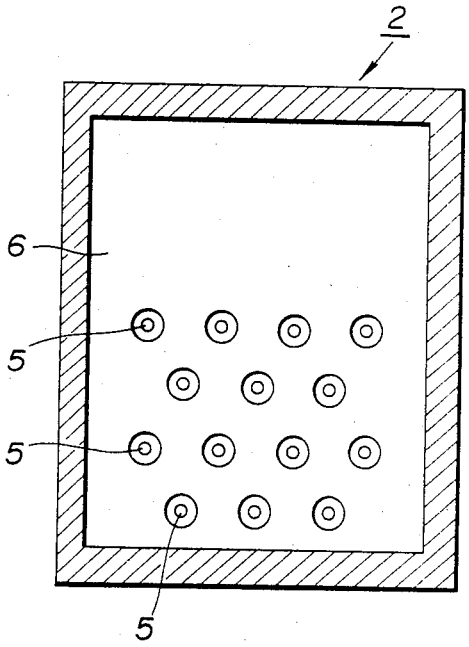
FIG.3 (PRIOR ART)
FIG. 3 is a section taken along line III—III of FIG. 2.

FIGS. 2 and 3 show a typical arrangement of burners 5 in the alloying furnace 2. As shown in FIGS. 2 and 3, the burners 5 are recessed in a furnace wall 6 opposite the sheet iron path. Each burner 5 directs its flame toward the sheet iron. To ensure uniform alloying heat across the sheet iron surface, the burners 5 are arrayed vertically and laterally in hexagonal loose packing or equidistant spacing. This arrangement results in the defects and drawbacks discussed above.

In order to resolve the defects and drawbacks in the conventional art, the burners in the furnace according to the present invention are arranged in horizontal alignment and the burner nozzles are directed upwards to form a screen of flame on both sides of the sheet iron passing through the furnace at a given spacing from the sheet iron surfaces.

In the preferred construction, several burners are grouped into burner blocks with the burner nozzles of each block arranged in horizontal alignment. A plurality of burner blocks are arranged in the furnace in horizontal alignment to form the flame screen mentioned above.

Figure 4:
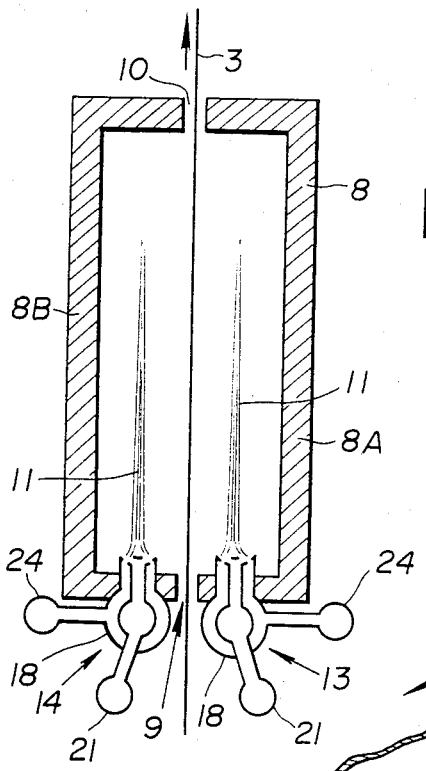
FIG. 4 is a view similar to FIG. 2 but showing the preferred embodiment of an alloying furnace according to the present invention.
Figure 5:
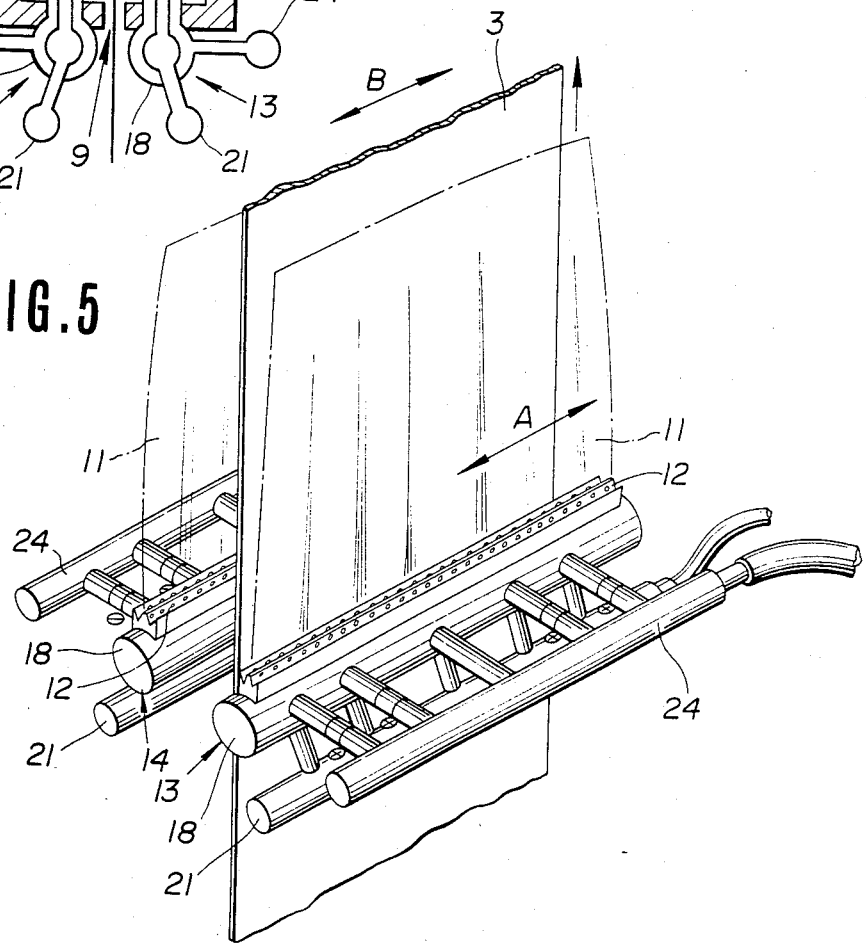
FIG. 5 is a perspective view of the furnace of FIG. 4, with the furnace walls removed.
Figure 6:
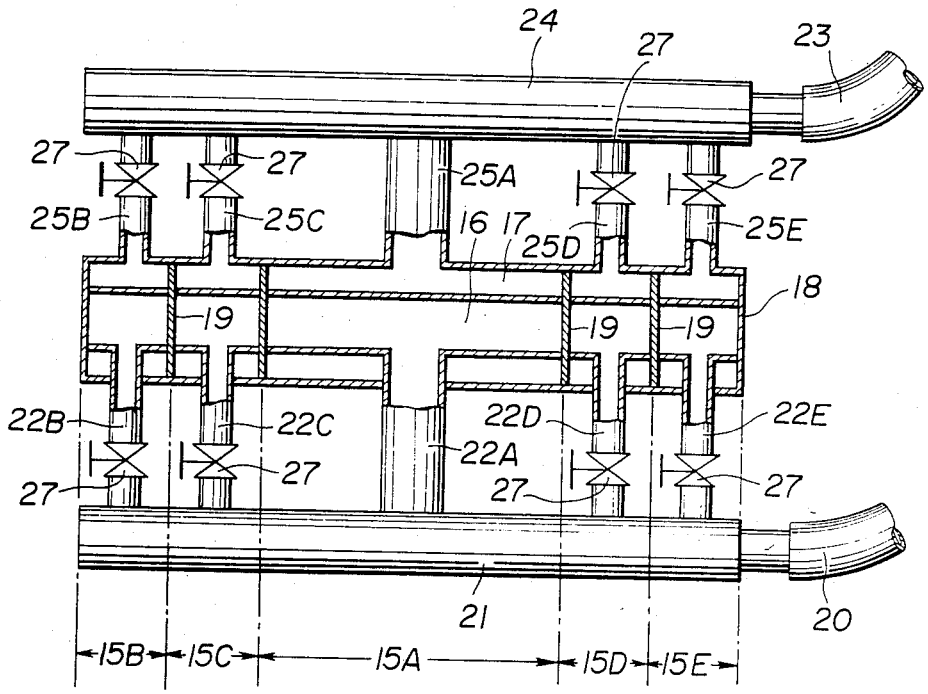
FIG. 6 is a partly sectioned view of a burner system employed in the preferred embodiment of the alloying furnace according to the invention.

FIGS. 4 to 6 show the preferred embodiment of an alloying furnace according to the present invention. As set forth above, the alloying furnace 2 is located above the molten zinc bath (not shown in FIGS. 4 to 6). The furnace 2 has a furnace body 8 made of refractory material, such as ceramic fiber which is significantly lighter than fire brick. The furnace body 8 has an inlet 9 at its lower end opposite the zinc bath, and an outlet 10 at its upper end. Sheet iron follows a path along the longitudinal axis of the furnace body from the inlet 9 to the outlet 10.

As will be seen from FIG. 1, the sheet iron 3 is a continuous sheet supplied from a sheet iron roll or the like and continuously enters the furnace 2 covered by a layer of zinc, the thickness of which is controlled by the zinc layer adjusting device 4.

Burner assemblies 13 and 14 are arranged to either side of the sheet iron path near the lower inlet 9. The burner assemblies 13 and 14 are each spaced a predetermined distance away from the sheet iron path. Each burner assembly 13 and 14 has one or more burner nozzles directed upwards to discharging flame upwards in the form of a screen, as shown in FIG. 5. The burner nozzles can be small diameter openings horizontally aligned parallel to the width of the sheet iron. Conversely, the burner nozzle of each burner 13 and 14 can be a narrow slit extending horizontally parallel to the sheet iron path. The essential thing is that the flame screen 11 formed by the flame discharged through the burner nozzles extend laterally (direction A in FIG. 5) essentially parallel to the lateral axis B of the sheet iron. Therefore, the burner nozzles should be aligned or the burner slit must extend parallel to the axis B, parallel to the plane of the iron sheet.

As shown in FIG. 6, each of the burners 13 and 14 is provided with a plurality of burner nozzles forming the flame screen 11 near the sheet iron. The burner body 18 comprises concentric inner and outer cylinders 16 and 17. The outer cylinder 17 is larger than the inner cylinder and so defines a cross-sectionally annular chamber serving as a ventilation air supply line. The inner cylinder 16 serves as a fuel supply line. The outer cylinder 17 and the inner cylinder 16*a* are respectively connected to air and gas nozzles which together constitute burner nozzles 12, as shown in FIG. 5.

The nozzles 12 in the burner body 18 are separated into a plurality of independent blocks 15A to 15E (FIG. 6), by means of partitions 19 through the gas supply cylinder 16 and the air supply cylinder 17. Each block 15A to 15E will be referred to hereafter as a "burner block". In each of the burner blocks 15A to 15E, the inner cylinder 16 is connected to a gas branch pipe 22. As shown in FIG. 6, in the preferred embodiment, the central burner block 15A is larger than the others 15B to 15E. The gas branch pipe 22A in the central block 15A is accordingly larger in diameter than the others. Each of the gas branch pipes 22 is connected to a gas distribution pipe 21. For establishing gas flow from the gas distribution pipe 21 to the gas chambers 16*a* of the burner blocks 15B to 15E, Gas flow control valves 27 in the branch pipes 22B to 22E control the gas flow through each of the branch lines 22B to 22E. The gas distribution pipe 21 is connected to a gas source (not shown) through a gas supply hose 20.

Similarly, the outer cylinder 17 is connected to a plurality of air branch pipes 25. One of the air branch pipes 25A to 25E is located in each of the burner blocks 15A to 15E. The length of the central burner block 15A and the diameter of its air branch pipe 25A are greater than the others. The air branch pipe 25A of the central block 15A is connected directly to an air distribution pipe 24. The other branch pipes 25B to 25E of the burner blocks 15B to 15E are connected to the air distribution pipe 24 through corresponding air flow control valves 27.

In this arrangement, gas supply and air supply can be adjusted for each burner block 15A to 15E independently. By adjusting the gas and air supply ratio to each burner block 15A to 15E, the combustion properties at each burner block can be adjusted so as to form a uniform flame screen near the sheet iron path. By ensuring uniform combustion in each transverse section across the sheet iron path, thermal gradients across the sheet iron and the molten zinc layer are minimized. Therefore, the solid solution rate of the iron and zinc on the surface of the sheet iron can be held nearly even across the entire width of the sheet iron.

In practical application of the alloying process, the flow control valves 27 in the branch pipes 22B to 22E and 25B to 25E are particularly useful in allowing alloying of various widths of sheet iron. For instance, if sheet iron narrow enough to be covered by the burner blocks 15A, 15C and 15D is to be galvanized, the gas flow control valves 27 of the branch pipes 22B and 22E can be shut to reduce the total gas consumption. This obviously conserves both energy and money.

In addition, according to the shown embodiment, since the burner assembly is installed near the lower end or the bottom of the furnace, the total load on the furnace wall due to the burner assembly is significantly less than in conventional furnaces. This allows the furnace wall to be made of ceramic fiber instead of fire bricks. As a result, the overall weight of the furnace can be remarkably reduced. This also significantly reduces the heat capacity of the furnace wall. The resulting improved thermal response characteristics of the furnace facilitates control of the alloying heat.

Figure 7:
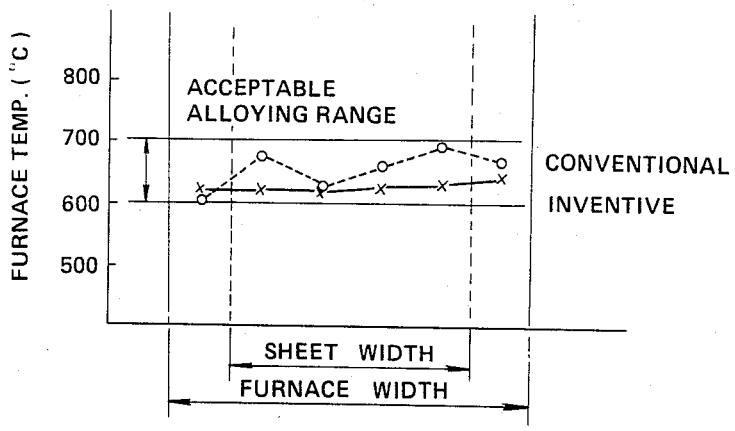
FIG. 7 is a graph showing typical lateral temperature distributions in the conventional furnace and the preferred embodiment of the inventive furnace.

FIGS. 7 and 8 show the results of experiments comparing the furnaces of FIGS. 2 and 4. FIG. 7 shows the lateral temperature distribution across the sheet iron path and thus the distribution of alloying heat applied to the sheet iron. As can be seen in FIG. 7, in the conventional furnace, the temperature varies laterally over the range of approximately 610° C. to 695° C. As mentioned above, the acceptable range for alloying the zinc layer onto the sheet iron is generally in the range of 600° C. to 700° C. Although experiment shows that the alloying heat can be held to within this acceptable range even in conventional furnaces, it tends frequently to exceed 700° C. or to drop below 600° C. when heating condition change. This could result in fluctuation of the alloying rate in some lateral sections of the sheet iron. This is due to the relatively wide temperature range across the sheet iron in the conventional furnace. On the other hand, as can be appreciated from FIG. 7, the lateral temperature distribution in the preferred embodiment of the alloying furnace varies merely over a range of approximately 20° C. This temperature range is significantly narrower than that of the conventional furnace. Therefore, even as the heating condition fluctuates, the alloying temperature in the preferred embodiment of the alloying furnace can be held within the allowable temperature range to ensure a Fe—Zn layer of uniform quality across the sheet iron surface.

Figure 8A:
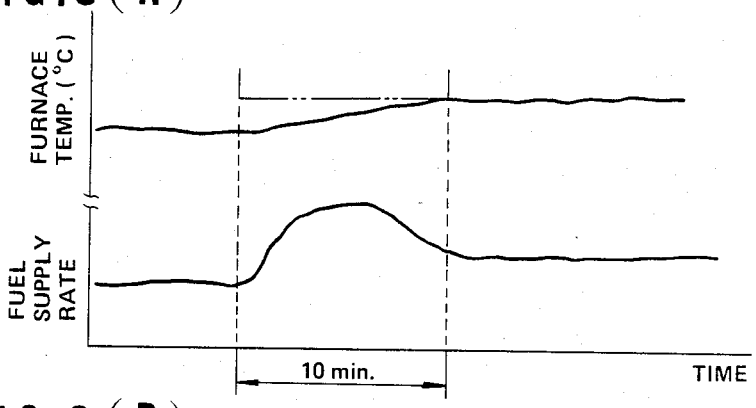
Figure 8B:
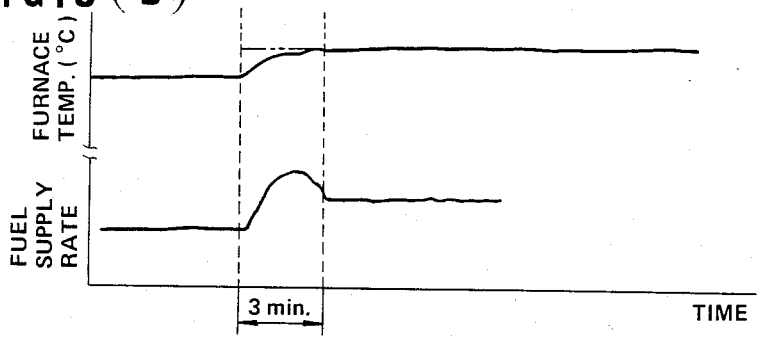

FIGS. 8(A) and 8(B) illustrate the response delay to changes in heating temperature in accordance with changes in the thickness of the sheet iron, and gas consumption during the temperature transition period. FIG. 8(A) shows the characteristics of the conventional furnace shown in FIGS. 2 and 3. As set forth above, the conventional furnace uses fire bricks in the furnace walls. In the conventional furnace, it takes 10 min. for the furnace temperature to increase 50° C. due to the massive heat capacity of the furnace walls. Increasing the furnace temperature of the preferred embodiment of the alloying furnace using ceramic fiber walls by 50° C. requires only about 3 min. The conventional furnace requires a much greater volume of gas then preferred embodiment of the furnace over this transition period.

As can be appreciated from FIGS. 8(A) and 8(B), the preferred embodiment of the alloying furnace according to the present invention can provide better thermal response characteristics less and fuel conservation when increasing the furnace temperature.

While a specific embodiment has been disclosed in order to fully describe the present invention, the shown embodiment should be appreciated as a mere example of the present invention. The present invention should be interpreted to include all possible embodiments and modifications which do not depart from the principle of the invention defined in the appended claims.

What is claimed is:

1. An alloying furnace for use in a galvanization process comprising:

a furnace body disposed above a molten zinc bath through which sheet iron is passed, said furnace body having a sheet metal inlet opposing said zinc bath, and a sheet iron outlet in its upperface, the sheet iron following a constant path through said furnace body; and a burner means disposed within said furnace body near said sheet iron inlet and extending in a first direction essentially across the width of said sheet iron, said burner means thereby being positioned to generate a screen-like flame extending in the first direction across the entire width of said sheet iron, said burner means lying essentially parallel to the plane of said sheet iron, and said burner means being spaced at a given distance from said sheet iron in a second direction perpendicular to the plane of said sheet iron.

2. The furnace as set forth in claim 1, wherein said burner means comprises a pair of burner assemblies disposed on opposite sides of said sheet iron path and spaced equally from said sheet iron path.

3. The furnace as set forth in claim 2, wherein each of said burner assemblies is separated into a plurality of independent blocks, and wherein means are provided whereby the flame from each of the blocks can be controlled independently.

4. The furnace as set forth in claim 3, wherein at least some of said blocks of said assembly have fuel flow control valves and air flow control valves facilitating independent combustion control.

5. The furnace as set forth in claim 1, wherein said furnace body is made of refractory ceramic fiber.

6. An alloying furnace for use in a galvanization process comprising:

a furnace body made of a material having relatively small heat capacity and disposed above a molten zinc bath through which sheet iron passes, said furnace body having a sheet iron inlet opposing said zinc bath, and a sheet iron outlet in its upperface, said sheet iron following a fixed path through said furnace body; and a pair of burner assemblies, each extending essentially parallel to the plane of the sheet iron and in the direction across the width of said sheet iron and disposed near said sheet iron inlet, each of said burner assemblies having burner nozzles directed upwards to generate a screen-like flame near said sheet iron path, which screen-like flame extends across the entire width of said sheet iron and lies essentially parallel to said sheet iron at a given distance therefrom.

7. The furnace as set forth in claim 6, wherein each of said burner assemblies are separated into a plurality of blocks, the flames generated by which can be controlled independently.

8. The furnace as set forth in claim 7, wherein each block of said burner assembly is independently connected to a fuel source through a fuel supply line and to an air source through an air supply line.

9. The furnace as set forth in claim 8, further comprising flow control valves for controlling the rate of fluid flow through each of said supply lines.

10. A method of forming a Fe—Zn alloy layer on the surface of sheet iron as part of a galvanization process, comprising the steps of:

passing sheet iron through a molten zinc bath and upwards out of the zinc bath; and forming a screen-like flame opposite and essentially parallel to both sides of said sheet iron above the zinc bath by means of a pair of horizontally aligned, laterally extending, upwardly directed burner assemblies.

11. The method as set forth in claim 10, which further comprises the steps of dividing each of said burner assemblies laterally into a plurality of independent blocks and controlling the combustion in each block independently.

12. The method as set forth in claim 11, in which said step of generating a screen-like flame includes a step of aligning said burner assemblies horizontally directly opposite and across the entire width of the sheet metal near said molten zinc bath.

* * * * *